US009851081B2

(12) United States Patent
Clark

(10) Patent No.: US 9,851,081 B2
(45) Date of Patent: Dec. 26, 2017

(54) WEDGE SHAPED HEAT SINK FOR GIMBAL MOUNTED SOLID STATE RECESSED LIGHTING

(71) Applicant: ABL IP Holding LLC

(72) Inventor: Stephen Howard Clark, Downers Grove, IL (US)

(73) Assignee: ABL IP Holding LLC, Atlanta, GA (US)

( * ) Notice: Subject to any disclaimer, the term of this patent is extended or adjusted under 35 U.S.C. 154(b) by 126 days.

(21) Appl. No.: 14/606,309

(22) Filed: Jan. 27, 2015

(65) Prior Publication Data

US 2015/0219407 A1 Aug. 6, 2015

Related U.S. Application Data

(60) Provisional application No. 61/934,989, filed on Feb. 3, 2014.

(51) Int. Cl.

| | |
|---|---|
| ***F21V 21/28*** | (2006.01) |
| ***F21S 8/02*** | (2006.01) |
| *F21V 7/00* | (2006.01) |
| *F21V 29/76* | (2015.01) |
| *F21Y 115/10* | (2016.01) |

(52) U.S. Cl.

CPC ..... *F21V 21/28* (2013.01); *F21S 8/026* (2013.01); *F21V 7/0091* (2013.01); *F21V 29/763* (2015.01); *F21Y 2115/10* (2016.08)

(58) Field of Classification Search

CPC ..... F21V 21/28; F21V 21/04; F21V 21/30; F21V 7/0091; F21V 29/763; F21Y 2115/10; F21S 8/026

See application file for complete search history.

(56) References Cited

U.S. PATENT DOCUMENTS

| | | | | |
|---|---|---|---|---|
| 6,632,006 | B1 * | 10/2003 | Rippel | F21S 8/02 362/147 |
| 7,744,259 | B2 * | 6/2010 | Walczak | F21V 14/02 362/294 |
| 8,182,116 | B2 | 5/2012 | Zhang et al. | |
| 8,403,533 | B1 * | 3/2013 | Paulsel | F21S 8/026 362/249.02 |

(Continued)

OTHER PUBLICATIONS

MX/A/2015/001422 , "Office Action", dated Aug. 14, 2017 (Spanish Translation—4 pages English Translation—4 pages).

*Primary Examiner* — Tho V Duong

(74) *Attorney, Agent, or Firm* — Kilpatrick Townsend & Stockton, LLP

(57) ABSTRACT

A heat sink for a directional recessed lighting fixture, comprises a wedge-shaped rotatable inner heat sink 110 configured to fit within a hollow interior of an outer heat sink 130. The inner heat sink has an opening 120, for transmission of light from a light source 125 it houses. The inner heat sink includes a gimbal shaft 115 pivotally mounted to an inside wall 132 of the outer heat sink. The inner heat sink has a vertical surface 112 formed on one side, which is close to inside wall 132, when rotated in one direction (FIG. 1A) to direct light in a first direction. The inner heat sink has an angularly offset surface 114 formed on an opposite side, which is close to the inside wall, when rotated in an opposite direction (FIG. 1B) to direct light in a second direction.

12 Claims, 5 Drawing Sheets

(56) References Cited

U.S. PATENT DOCUMENTS

| | | | | |
|---|---|---|---|---|
| 2010/0061108 | A1* | 3/2010 | Zhang | F21V 29/004 362/364 |
| 2010/0315812 | A1* | 12/2010 | Liu | F21K 9/00 362/235 |
| 2012/0217897 | A1* | 8/2012 | Gordin | F21S 8/086 315/294 |
| 2014/0204574 | A1* | 7/2014 | Ebisawa | F21S 8/026 362/235 |

* cited by examiner

WEDGE SHAPED HEAT SINK FOR GIMBAL MOUNTED SOLID STATE RECESSED LIGHTING

This patent application claims benefit under 35 U.S.C. 119(e), of the earlier filing date of U.S. Provisional Patent Application Ser. No. 61/934,989, filed Feb. 3, 2014.

BACKGROUND OF THE INVENTION

1. Field of the Invention

The invention disclosed relates generally to lighting fixtures and in particular to heat dissipation in recessed lighting fixtures.

2. Discussion of the Related Art

Recessed lighting fixtures are designed to be minimally visible from below a ceiling in which they are mounted. LED light sources used for recessed lighting typically generate significant quantities of heat, requiring the use of a heat sink as part of the lighting fixture, to avoid overheating. The LED light source and an associated optic, are typically mounted in the heat sink so as to project light from the bottom of the heat sink. In some designs the heat sink may be supported in a mounting frame that is suspended by bar hangers fastened between joists above the ceiling. The mounting frame is positioned so that the bottom of the heat sink passes through an opening in the ceiling and is approximately flush with the bottom surface of the ceiling. A trim ring typically surrounds the opening in the ceiling, to mask the opening.

Directional LED recessed lighting fixtures are available, wherein a pivoted support or gimbal supports the heat sink and allows the rotation of the heat sink about a single axis. The directional or gimbal LED is typically capable of an adjustment range of from 0°-35° from vertical, for example. Conventionally, the heat sink containing the optic, is a rotatable inner heat sink that is pivotally mounted by gimbal supports within an outer heat sink. The inner heat sink is often the primary heat sink for the LED. Thus, it is an advantage to have the largest possible inner heat sink, to allow the LED to run at the coolest temperature possible.

An example directional or gimbal LED lighting fixture is described in U.S. Pat. No. 8,182,116, which depicts a heat sink that is pivotally mounted by gimbal supports within a much larger housing. The disclosed design does not enlarge the size of the heat sink to maximize its heat dissipation characteristics, since there is a large unused space shown within the housing.

Another example directional or gimbal LED lighting fixture is described in U.S. Pat. No. 8,403,533, which depicts an inner heat sink that is pivotally mounted by gimbal supports within an outer heat sink. The inner heat sink includes an arm that moves up into the outer heat sink for hinge tension and heat transfer. However the shape of the inner heat sink is not optimized to be as large as possible and yet still be capable of directional adjustment on its gimbal supports.

Accordingly, there is a need for a design of a rotatable inner heat sink for a directional or gimbal mounted LED recessed lighting fixture, which occupies a maximum available volume within an outer heat sink, and yet is still capable of directional adjustment on its gimbal supports.

SUMMARY OF THE INVENTION

Example embodiments of the invention provide an improved design of a rotatable inner heat sink for a directional or gimbal LED lighting fixture, which occupies a maximum available volume within an outer heat sink, and yet is capable of full directional adjustment on its gimbal supports.

In accordance with an example embodiment of the invention, a heat sink for a directional lighting fixture comprises a rotatable inner heat sink that is generally wedge-shaped with a narrow top portion and a broader bottom portion. The inner heat sink is configured to fit within a hollow interior of an outer heat sink that has a substantially vertical inside wall. The inner heat sink has an opening in the bottom portion for transmission of light from a light source housed within the inner heat sink. The bottom portion of the inner heat sink is configured to be exposed through an opening at a bottom of the outer heat sink, to enable further transmission of the light transmitted from the opening in the inner heat sink.

A gimbal shaft is configured to pivotally mount the rotatable inner heat sink to the inside wall of the outer heat sink.

The rotatable inner heat sink has a vertical surface formed on one side between the narrow top portion and the broader bottom portion. The vertical surface is close to the inside wall of the outer heat sink, when the inner heat sink is rotated in one direction on the gimbal shaft, to direct light in a first direction.

The rotatable inner heat sink has an offset surface that is offset by an acute angle from vertical and intersects the vertical surface. The offset surface is formed on an opposite side of the inner heat sink from the one side, between the narrow top portion and the broader bottom portion. The offset surface is close to the inside wall of the outer heat sink, when the inner heat sink is rotated in an opposite direction to the one direction on the gimbal shaft, to direct light in a second direction.

In this manner, the rotatable inner heat sink occupies a maximum available volume within the outer heat sink, and yet is still capable of directional adjustment on its gimbal supports.

Two example embodiments are described for the rotatable inner heat sink. In a first example embodiment, the vertical surface of the rotatable inner heat sink is planar and the offset surface of the rotatable inner heat sink is substantially planar and may include heat-dissipating ribs. In a second example embodiment, the vertical surface of the rotatable inner heat sink is cylindrical and the offset surface of the rotatable inner heat sink is substantially cylindrical and may include heat-dissipating ribs.

The rotatable inner heat sink may have an offset surface that is offset by an angle from vertical that ranges from 0 degrees to 35 degrees.

The light source housed within the rotatable inner heat sink may be an LED light source.

The bottom portion of the rotatable inner heat sink may have a diameter that is approximately the same as the opening at the bottom of the outer heat sink.

DETAILED DESCRIPTION OF EMBODIMENTS OF THE INVENTION

Example embodiments of the invention provide an improved design of a rotatable inner heat sink for a directional or gimbal mounted LED recessed lighting fixture, which occupies a maximum available volume within an outer heat sink, and yet is capable of full directional adjustment on its gimbal supports.

Figure 1A:
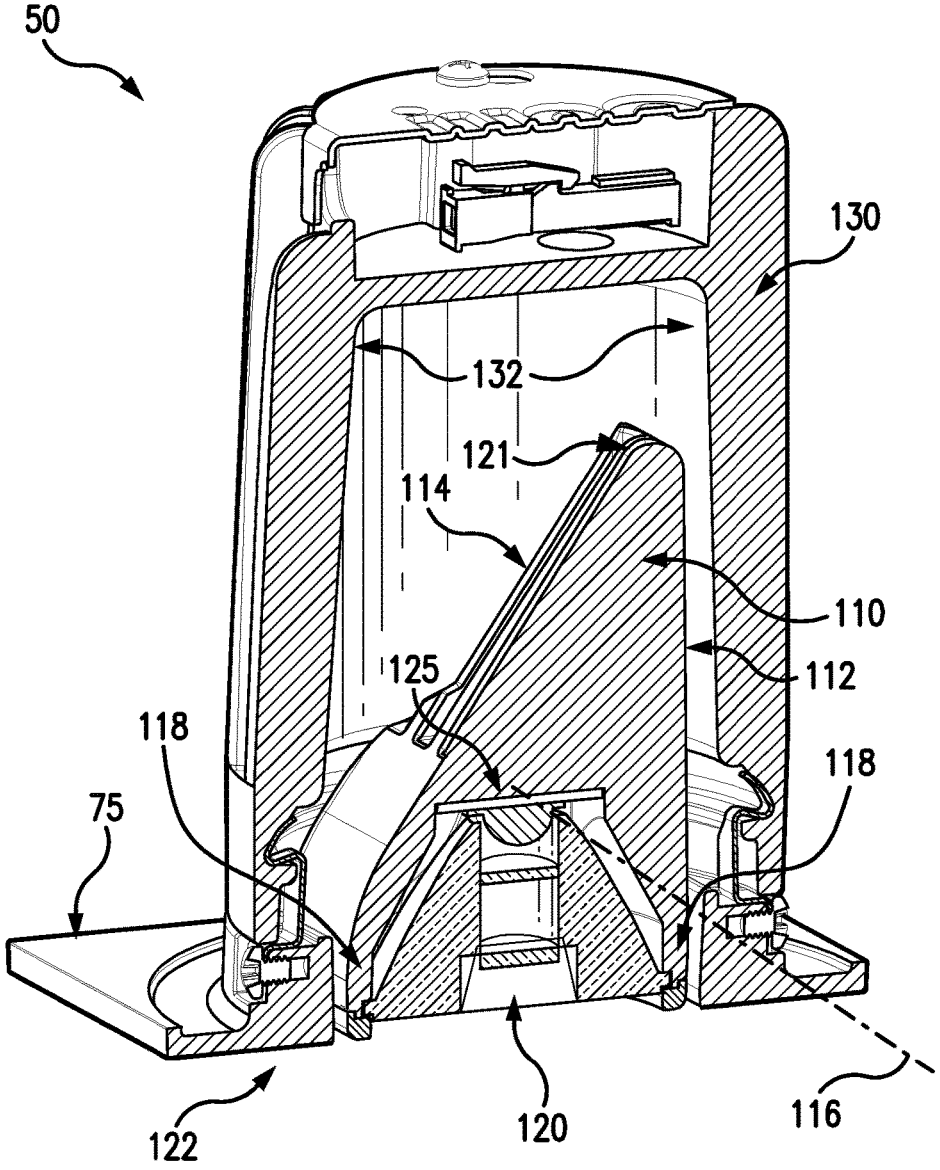
FIG. 1A is a front perspective view from the right side, in partial cross section, of a heat sink for a directional lighting fixture with a rotatable inner heat sink that is generally wedge-shaped to fit within a hollow interior of an outer heat sink that has a substantially vertical inside wall. The rotatable inner heat sink is shown rotated in one direction to direct light in a first direction. The figure shows a first embodiment of the wedge-shaped rotatable inner heat sink comprised of a vertical surface that is planar and an offset surface that is substantially planar and includes heat-dissipating ribs.

FIG. 1A is a front perspective view from the right side, in partial cross section, of a recessed fixture 50 for a directional lighting fixture. The trim frame 75 rests against the room side of the ceiling (not shown). The recessed fixture 50 includes a rotatable inner heat sink 110 that is generally wedge-shaped to fit within a hollow interior of an outer heat sink 130 that has a substantially vertical inside wall 132 that may be generally cylindrical. The wedge-shaped rotatable inner heat sink 110 is shown rotated in one direction to direct light in a first direction, generally shown as a vertical direction. The figure shows a first embodiment of the wedge-shaped rotatable inner heat sink comprised of a vertical surface 112 that is planar and an offset surface 114 that is substantially planar and includes heat-dissipating ribs.

The wedge-shaped rotatable inner heat sink 110 has a narrow top portion 121 and a broader bottom portion 118 and has an opening 120 in the bottom portion for transmission of light from a light source 125 housed within the rotatable inner heat sink 110. The bottom portion 118 of the wedge-shaped rotatable inner heat sink 110 is configured to be exposed through an opening 122 at a bottom of the outer heat sink 130, to enable further transmission of the light transmitted from the opening 120 in the rotatable inner heat sink 110.

The first embodiment of the wedge-shaped rotatable inner heat sink 110 has the vertical flat or planar surface 112 formed on one side between the narrow top portion 121 and the broader bottom portion 118. The vertical surface 112 is substantially parallel and close to the inside wall 132 of the outer heat sink 130, when the rotatable inner heat sink 110 is rotated in one direction (shown in FIG. 1A) on a gimbal shaft 115 (shown in FIG. 1C), to direct light in a first direction, generally shown as a vertical direction in FIG. 1A. The gimbal shaft 115 is configured to pivotally mount the rotatable inner heat sink 110 to the inside wall 132 of the outer heat sink 130, to enable rotation of the rotatable inner heat sink 110 about the axis 116.

Figure 1B:
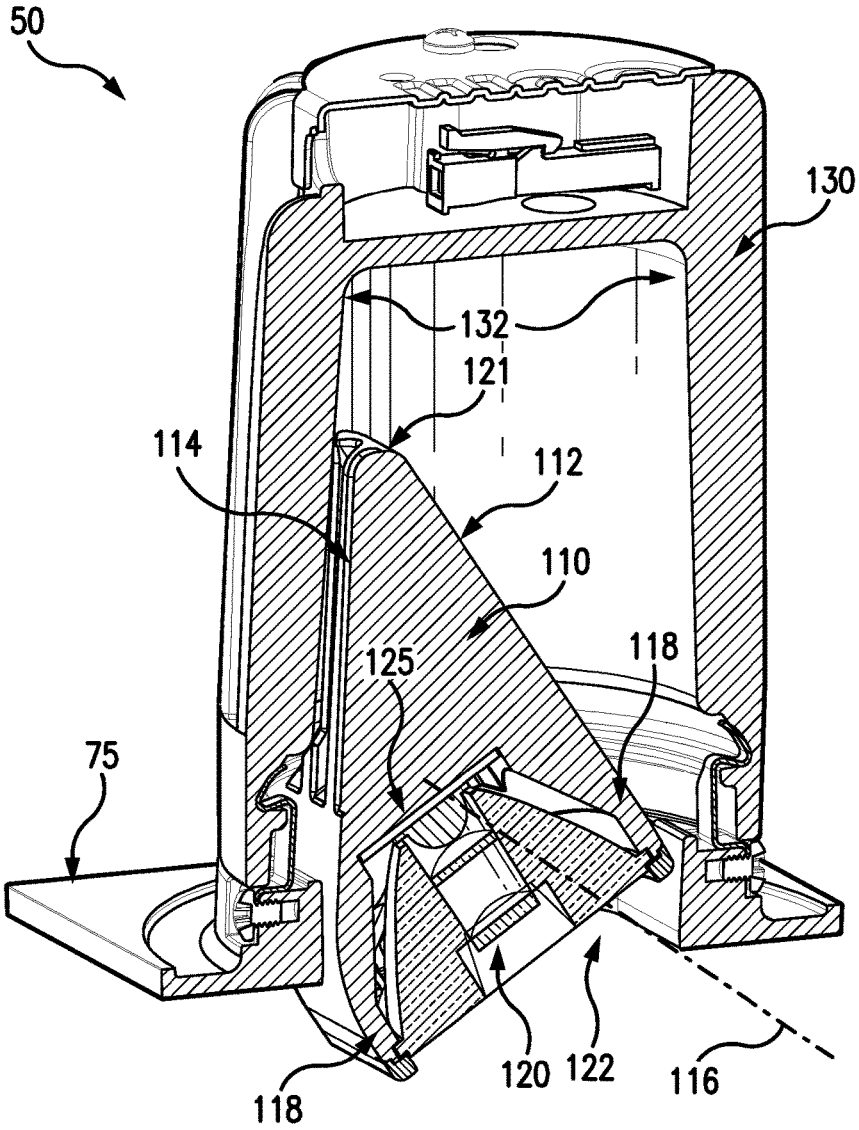
FIG. 1B is a front perspective view from the right side, in partial cross section, of the heat sink of FIG. 1A, with the first embodiment of the wedge-shaped rotatable inner heat sink shown rotated in an opposite direction from that shown in FIG. 1A, to direct light in a second direction.

FIG. 1B is a front perspective view from the right side, in partial cross section, of the recessed fixture 50 of FIG. 1A, with the rotatable inner heat sink 110 shown rotated in an opposite direction from that shown in FIG. 1A, to direct light in a second direction, generally shown as directed at an acute angle offset from the vertical direction. The rotatable inner heat sink 110 has an offset surface 114 that is offset by an acute angle from vertical. The offset surface 114 of the rotatable inner heat sink 110 is substantially planar and may include heat-dissipating ribs. The offset surface 114 intersects the vertical surface 110 at the narrow top portion 121 of the rotatable inner heat sink 110. The offset surface 114 is formed on an opposite side of the rotatable inner heat sink 110 from the vertical surface 112, between the narrow top portion 121 and the broader bottom portion 118. The offset surface 114 is substantially parallel and close to the inside wall 132 of the outer heat sink 130, when the rotatable inner heat sink 110 is rotated on the gimbal shaft 115, in an opposite direction (shown in FIG. 1B) to the direction shown in FIG. 1A. Light is thereby directed in a second direction, generally shown as directed at an acute angle offset from the vertical direction, as shown in FIG. 1B.

In this manner, the rotatable inner heat sink 110 occupies a maximum available volume within the outer heat sink 130, and yet is still capable of directional adjustment about the axis 116, on its gimbal supports 115.

The rotatable inner heat sink 110 may have an offset surface 114 that is offset by an angle from vertical that ranges from 0 degrees to 35 degrees.

The light source 125 housed within the rotatable inner heat sink 110, may be an LED light source.

The bottom portion 118 of the rotatable inner heat sink 110 may have a diameter that is approximately the same as the opening 122 at the bottom of the outer heat sink 130.

Figure 1C:
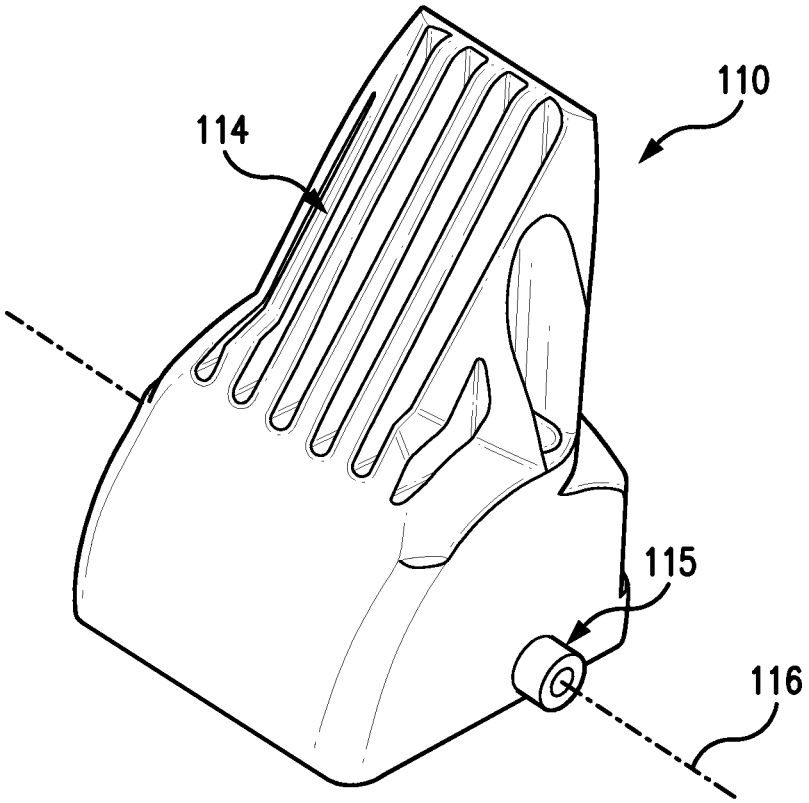
FIG. 1C is a top front perspective view from the right side, of the first embodiment of the wedge-shaped rotatable inner heat sink, showing a gimbal shaft configured to pivotally mount the rotatable inner heat sink to the inside wall of the outer heat sink.

FIG. 1C is a top front perspective view from the right side, of the first embodiment of the wedge-shaped rotatable inner heat sink 110, showing the gimbal shaft 115 configured to pivotally mount the rotatable inner heat sink 110 to the inside wall 132 of the outer heat sink 130, for rotation about the axis 116. Heat dissipating ribs are shown formed in the offset surface 114.

Figures 2A, 2B, 2C, 2D, 2E, 2F:
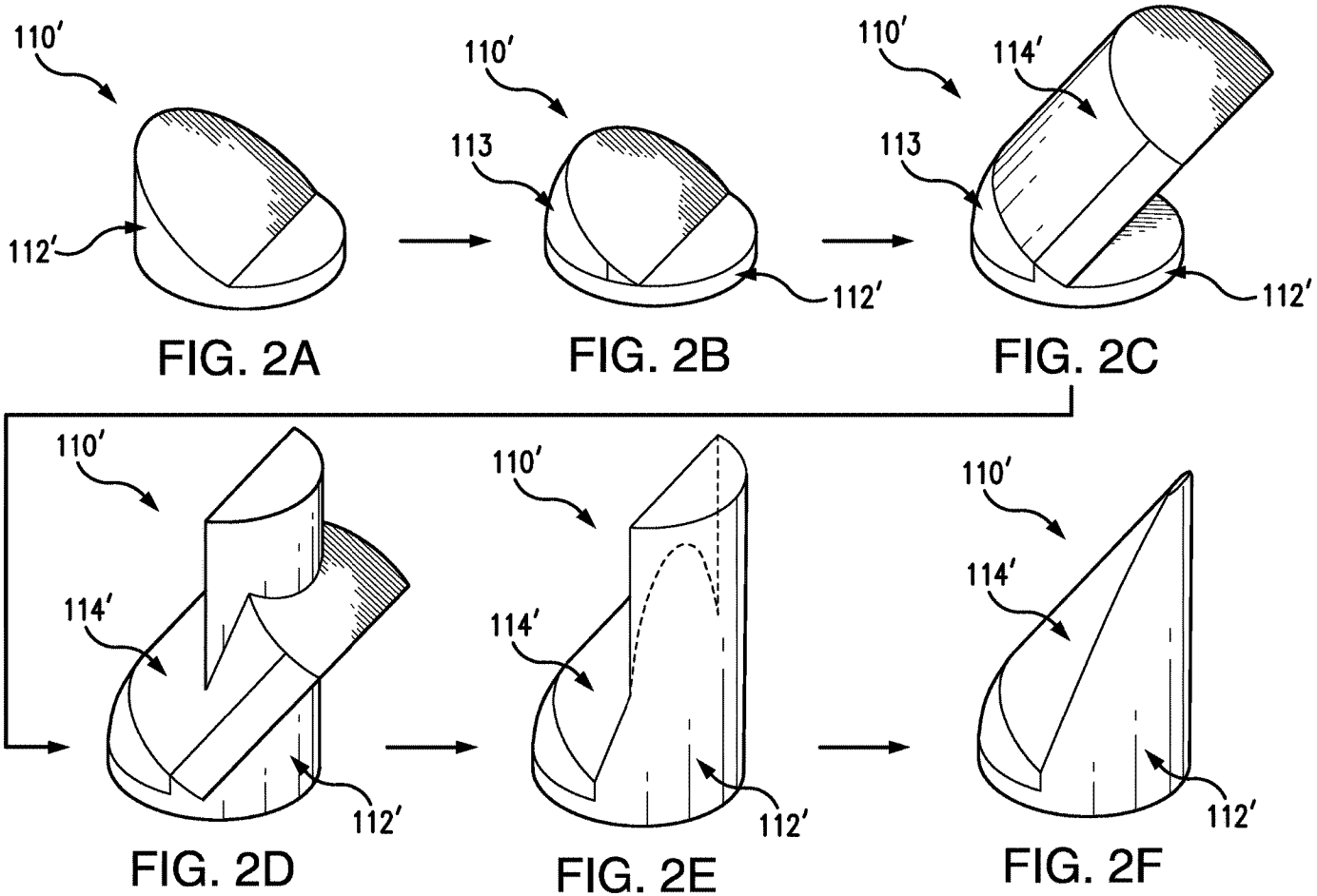
FIGS. 2A to 2F is a sequence of top front perspective views from the left side, of component geometric shapes that comprise a second embodiment of the wedge-shaped rotatable inner heat sink shown in FIGS. 3A to 3C. The second embodiment of the wedge-shaped rotatable inner heat sink is comprised of a vertical surface that is cylindrical and an offset surface that is substantially cylindrical.
Figure 3C:
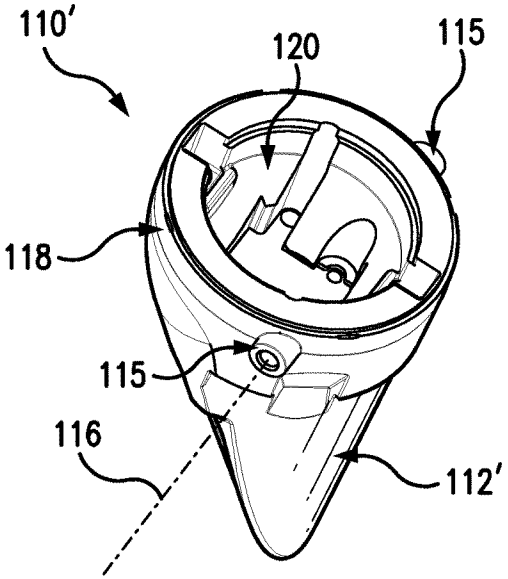
FIG. 3C is a bottom back perspective view from the left side, of the second embodiment of the wedge-shaped rotatable inner heat sink, showing an opening in the bottom portion for transmission of light from a light source housed within the rotatable inner heat sink.
Figure 3B:
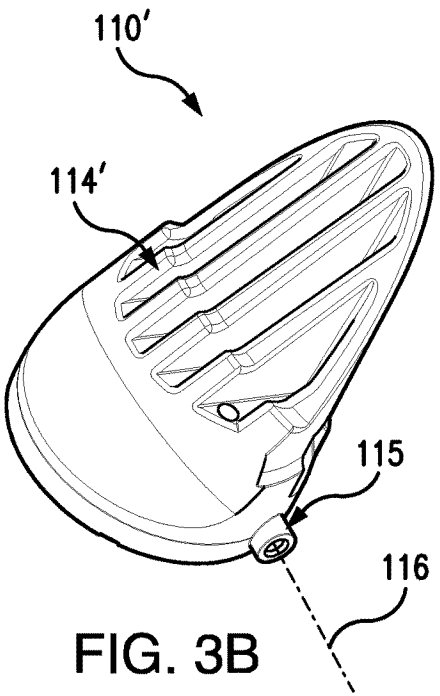
FIG. 3B is a top front perspective view from the right side, of the second embodiment of the wedge-shaped rotatable inner heat sink, showing the offset cylindrical surface.
Figure 3A:
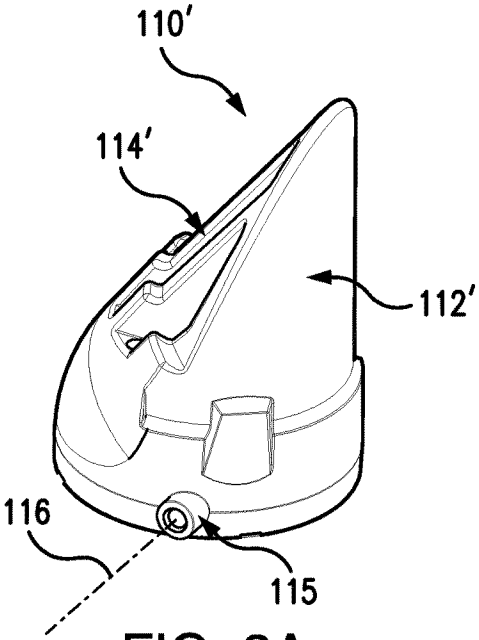
FIG. 3A is a top front perspective view from the left side, of the second embodiment of the wedge-shaped rotatable inner heat sink, showing a vertical cylindrical surface on one side and an offset cylindrical surface on the opposite side that includes heat-dissipating ribs.

FIGS. 2A to 2F is a sequence of top front perspective views from the left side, of component geometric shapes that comprise a second embodiment of the wedge-shaped rotatable inner heat sink 110' shown in FIGS. 3A to 3C. The second embodiment of the wedge-shaped rotatable inner heat sink 110 is comprised of a vertical surface 112' that is cylindrical and an offset surface 114' that is substantially cylindrical.

The second embodiment of the wedge-shaped rotatable inner heat sink 110' fits within the hollow interior of the outer heat sink 130 of FIG. 1A, in the same manner as was described above for the first embodiment 110. The second embodiment of the wedge-shaped rotatable inner heat sink 110' includes the gimbal shaft 115 (shown in FIG. 3A) to pivotally mount the second embodiment of the rotatable inner heat sink 110' to the inside wall 132 of the outer heat sink 130. The gimbal shaft 115 enables rotation of the second embodiment of the rotatable inner heat sink 110' about the axis 116, in the same manner as was described above for the first embodiment 110.

FIGS. 2A to 2F is a sequence of top front perspective views from the left side, of the second embodiment of the wedge-shaped rotatable inner heat sink 110', showing component geometric shapes that comprise the second embodiment of the wedge-shaped rotatable inner heat sink 110'.

FIG. 2A is a top front perspective view from the left side, showing a cylinder forming a portion of the vertical cylindrical surface 112' that comprises the second embodiment of the wedge-shaped rotatable inner heat sink 110'.

FIG. 2B is a top front perspective view from the left side, showing a spherical surface 113 that abuts a portion of the vertical cylindrical surface 112' that comprise the second embodiment of the wedge-shaped rotatable inner heat sink 110'.

FIG. 2C is a top front perspective view from the left side, showing a cylinder forming a portion of the offset cylindrical surface 114' abutting the spherical surface 113 that comprise the second embodiment of the wedge-shaped rotatable inner heat sink 110'.

FIG. 2D is a top front perspective view from the left side, showing a cylinder forming a portion of the offset cylindrical surface 114' intersecting and passing through the vertical cylindrical surface 112' that comprise the second embodiment of the wedge-shaped rotatable inner heat sink 110'.

FIG. 2E is a top front perspective view from the left side, showing a portion of the cylinder forming the offset cylindrical surface 114', trimmed so that it does not pass through the vertical cylindrical surface 112' that comprise the second embodiment of the wedge-shaped rotatable inner heat sink 110'.

FIG. 2F is a top front perspective view from the left side, showing the offset cylindrical surface 114' and the vertical cylindrical surface 112' that comprise the second embodiment of the wedge-shaped rotatable inner heat sink 110'.

FIG. 3A is a top front perspective view from the left side, of the second embodiment of the wedge-shaped rotatable inner heat sink 110', showing the vertical cylindrical surface 112' on one side and the offset cylindrical surface 114' on the opposite side. The gimbal shaft 115 is shown, to pivotally mount the second embodiment of the wedge-shaped rotatable inner heat sink 110'to the inside wall 132 of the outer heat sink 130, for rotation about the axis 116.

FIG. 3B is a top front perspective view from the right side, of the second embodiment of the wedge-shaped rotatable inner heat sink 110', showing the offset cylindrical surface 114'. Heat dissipating ribs are shown formed in the offset cylindrical surface 114'. The gimbal shaft 115 and axis 116 are shown.

FIG. 3C is a bottom back perspective view from the left side, of the second embodiment of the wedge-shaped rotatable inner heat sink 110', showing the opening 120 in the bottom portion 118 for transmission of light from a light source housed within the second embodiment of the wedge-shaped rotatable inner heat sink 110'. The vertical cylindrical surface 112', gimbal shaft 115 and axis 116 are shown.

The resulting embodiments of the wedge-shaped rotatable inner heat sink for a directional or gimbal mounted LED recessed lighting fixture, occupies a maximum available volume within the outer heat sink, and yet is still capable of directional adjustment on its gimbal supports.

The invention claimed is:

1. A heat sink for a directional lighting fixture, comprising:

a rotatable inner heat sink being generally wedge-shaped with a narrow top portion and a broader bottom portion, the rotatable inner heat sink being configured to fit within a hollow interior of an outer heat sink that has a substantially vertical inside wall, the rotatable inner heat sink having an opening in the bottom portion for transmission of light from a light source housed within the rotatable inner heat sink, the bottom portion of the rotatable inner heat sink being configured to be exposed through an opening at a bottom of the outer heat sink to enable further transmission of the light transmitted from the opening in the rotatable inner heat sink;

a gimbal shaft configured to pivotally mount the rotatable inner heat sink to the inside wall of the outer heat sink;

the rotatable inner heat sink having a vertical surface formed on one side between the narrow top portion and the broader bottom portion, the vertical surface being close to the inside wall of the outer heat sink, when the rotatable inner heat sink is rotated in one direction on the gimbal shaft, to direct light in a first direction, wherein the vertical surface of the rotatable inner heat sink is a first cylindrical surface portion and the offset surface of the rotatable inner heat sink is a second, substantially cylindrical surface portion; and the rotatable inner heat sink having an offset surface that is offset by an acute angle from vertical and intersects the vertical surface, the offset surface being formed on an opposite side of the rotatable inner heat sink from the one side, between the narrow top portion and the broader bottom portion, the offset surface being close to the inside wall of the outer heat sink, when the rotatable inner heat sink is rotated in an opposite direction to the one direction on the gimbal shaft, to direct light in a second direction.

2. The heat sink for a directional lighting fixture of claim 1, wherein the offset surface is offset by an angle from vertical of between 0 degrees and 35 degrees.

3. The heat sink for a directional lighting fixture of claim 1, wherein the light source housed within the rotatable inner heat sink is an LED light source.

4. The heat sink for a directional lighting fixture of claim 1, wherein the offset surface forms heat dissipating ribs.

5. The heat sink for a directional lighting fixture of claim 1, wherein the opening in the bottom of the outer heat sink is characterized by a diameter, and the broader bottom portion of the rotatable inner heat sink has a diameter that is approximately the same as the diameter of the opening.

6. The heat sink for a directional lighting fixture of claim 1, wherein the vertical surface is a smooth, continuously curved surface, and the offset surface comprises heat dissipating ribs that extend along the offset surface at the acute angle.

7. A heat sink for a directional lighting fixture, comprising:

a rotatable inner heat sink being generally wedge-shaped with a narrow top portion and a broader bottom portion, the rotatable inner heat sink being configured to fit within a hollow interior of an outer heat sink that has a substantially vertical inside wall, the rotatable inner heat sink having an opening in the bottom portion for transmission of light from a light source housed within the rotatable inner heat sink, the bottom portion of the rotatable inner heat sink being configured to be exposed through an opening at a bottom of the outer heat sink to enable further transmission of the light transmitted from the opening in the rotatable inner heat sink; and a gimbal shaft configured to pivotally mount the rotatable inner heat sink to the inside wall of the outer heat sink, wherein:

the rotatable inner heat sink has a vertical surface formed on one side between the narrow top portion and the broader bottom portion, the vertical surface being close to the inside wall of the outer heat sink, when the rotatable inner heat sink is rotated in one direction on the gimbal shaft, to direct light in a first direction, the rotatable inner heat sink has an offset surface that is offset by an acute angle from vertical and intersects the vertical surface, the offset surface being formed on an opposite side of the rotatable inner heat sink from the one side, between the narrow top portion and the broader bottom portion, the offset surface being close to the inside wall of the outer heat sink, when the rotatable inner heat sink is rotated in an opposite direction to the one direction on the gimbal shaft, to direct light in a second direction, and the vertical surface extends directly from the broader bottom portion of the rotatable inner heat sink on the one side, and a spherical surface portion is interposed between the broader bottom portion of the rotatable inner heat sink and the offset surface on the opposite side.

8. The heat sink for a directional lighting fixture of claim 7, wherein the vertical surface of the rotatable inner heat sink is a first cylindrical surface portion and the offset surface of the rotatable inner heat sink is a second, substantially cylindrical surface portion.

9. The heat sink for a directional lighting fixture of claim 7, wherein the vertical surface is a smooth, continuously curved surface, and the offset surface comprises heat dissipating ribs that extend along the offset surface at the acute angle.

10. The heat sink for a directional lighting fixture of claim 7, wherein the offset surface is offset by an angle from vertical of between 0 degrees and 35 degrees.

11. The heat sink for a directional lighting fixture of claim 7, wherein the light source housed within the rotatable inner heat sink is an LED light source.

12. The heat sink for a directional lighting fixture of claim 7, wherein the opening in the bottom of the outer heat sink is characterized by a diameter, and the broader bottom portion of the rotatable inner heat sink has a diameter that is approximately the same as the diameter of the opening.

* * * * *